US006758658B2

(12) United States Patent
Fujita et al.

(10) Patent No.: US 6,758,658 B2
(45) Date of Patent: Jul. 6, 2004

(54) SCROLL COMPRESSOR

(75) Inventors: Katsuhiro Fujita, Nishi-kasugai-gun (JP); Makoto Takeuchi, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/158,058

(22) Filed: May 31, 2002

(65) Prior Publication Data

US 2002/0182093 A1 Dec. 5, 2002

(30) Foreign Application Priority Data

May 31, 2001 (JP) ..... 2001-165571

(51) Int. Cl.[7] ..... F04C 18/04
(52) U.S. Cl. ..... 418/55.2
(58) Field of Search ..... 418/55.2

(56) References Cited

U.S. PATENT DOCUMENTS 4,477,238 A * 10/1984 Terauchi ..... 418/55.2
5,630,684 A 5/1997 Yamaguchi et al.
5,765,999 A * 6/1998 Ito et al. ..... 418/55.2
5,807,088 A 9/1998 Fukanuma et al.

FOREIGN PATENT DOCUMENTS

JP 58-030494 2/1983
JP 04166689 A * 6/1992 ..... F04C/18/02
JP 04-311693 11/1992
JP 08-028461 1/1996
JP 8-61268 3/1996
JP 09-112456 5/1997
JP 9-136133 5/1997

OTHER PUBLICATIONS

U.S. patent application Ser. No. 09/985,493, filed Nov. 5, 2001, pending.
U.S. patent application Ser. No. 10/040,622, filed Jan. 9, 2002, pending.
U.S. patent application Ser. No. 10/049,911, filed Feb. 20, 2002, pending.
U.S. patent application Ser. No. 10/049,903, filed Feb. 20, 2002, pending.
U.S. patent application Ser. No. 10/158,058, filed May 31, 2002, pending.
U.S. patent application Ser. No. 10/158,058, Fujita et al., filed May 31, 2002.
U.S. patent application Ser. No. 10/414,015, Takeuchi et al., filed Apr. 16, 2003.

* cited by examiner

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

In a scroll compressor equipped with fixed scroll member 1 and orbiting scroll member 2 having step portions 4, a convex side end of at least one step portion of each of scroll members 1 and 2 has chamfered portions 1*f* and 2*f* which are formed lower than an extrapolated line of an upper edge.

2 Claims, 6 Drawing Sheets

SCROLL COMPRESSOR

BACKGROUND OF THE INVENTION

1. Field of the Invention

The present invention relates to a scroll compressor installed in an air conditioner, a refrigerator, or the like, and in particular, relates to the shape of a scroll member.

2. Description of Related Art

FIG. 6 shows a cross-sectional view of a scroll compressor which is conventionally used. The scroll compressor comprises housing 6, fixed scroll member 1 which is fixed in housing 6, and orbiting scroll member 2 which is provided in housing 6 so as to freely rotate therein. Front case 5 which supports the orbital movement of orbiting scroll member 2 is fixed at an opening end side of housing 6, and shaft 7 which operates orbiting scroll member 2 so as to rotate is provided in front case 5. In shaft 7, crank pin 7*a* having axis X2 which is offset from axis X1 of shaft 7 is provided. This crank pin 7*a* is connected to boss 2*c* which is formed in the center of orbiting scroll member 2.

Fixed scroll member 1 is composed of fixed end plate (end plate) 1*a* and spiral wall body 1*b*. Orbiting scroll member 2 is composed of orbiting end plate (end plate) 2*a* and spiral wall body 2*b*. Spiral wall body 2*b* of orbiting scroll member 2 is assembled to spiral wall 1*b* of fixed scroll member 1, out of phase by 180 degrees, with spiral wall bodies 1*b* and 2*b* engaged with each other. Orbiting scroll member 2 orbitally moves with respect to fixed scroll member 1 via shaft 7. Accordingly, a compression chamber is formed between spiral wall bodies 1*b* and 2*b*. The volume of the compression chamber is gradually reduced by this orbital movement so that fluid in the compression chamber is compressed. The compressed high pressure fluid is ultimately discharged from discharge port 1*c* which is provided in the center of fixed end plate 1*a*.

In the above-described scroll compressor, the volume of the compression chamber, which is a crescent-shaped airtight space formed at the outermost portion by both scroll members 1 and 2, is the volume of the fluid to be taken in, and the volume is gradually compressed. In order to increase the amount of the fluid to be taken in, that is, the volume to be compressed, it is required that the number of windings of each of spiral wall bodies 1*b* and 2*b* is increased or the height of each of spiral wall bodies 1*b* and 2*b* be increased. However, if the height of each of spiral wall bodies 1*b* and 2*b* be increased, there is a problem in that the rigidity of spiral wall bodies 1*b* and 2*b* against the compression reaction force of the fluid decreases.

In order to solve the above problem, the following construction is disclosed in Japanese Patent No. 1296413. FIGS. 7A and 7B are perspective views of fixed scroll member 1 and orbiting scroll member 2 proposed in Japanese Patent No. 1296413.

Fixed scroll member 1 is composed of fixed end plate 1*a* and spiral wall body 1*b* which is erected on a side surface of this fixed end plate 1*a*. This fixed end plate 1*a* is formed so as to correspond to the height of spiral wall body 2*b* of orbiting scroll member 2 to engage with a bottom portion by spiral wall body 1*b* which is composed of shallow bottom portion 1*d* (high site), which becomes high at the center side, and deep bottom portion 1*e* (low site), which becomes low at the outer peripheral end side.

Furthermore, orbiting scroll member 2 is composed of orbiting end plate 2*a* and spiral wall body 2*b* which is erected on a side surface of this orbiting end plate 2*a*. This orbiting end plate 2*a* is formed so as to correspond to the height of spiral wall body 1*b* of fixed scroll member 1 to engage with a bottom part of spiral wall body 2*b* which is composed of shallow bottom portion 2*d* (high site), which becomes high at the center side, and deep bottom portion 2*e* (low site), which becomes low at the outer peripheral end side.

At a side surface of each of end plates 1*a* and 2*a* of fixed scroll member 1 and orbiting scroll member 2, bottom side step portion 3 (step portion), which is high at the center portion and low at the outer peripheral end side, is formed. Additionally, corresponding to bottom side step portion 3 of each of end plates 1*a* and 2*a*, wall body side step portion 4 (step portion), which is low at the center portion and high at the outer peripheral end side, is formed on the spiral top edge of each of spiral wall bodies 1*b* and 2*b*.

As a result, bottom side step portion 3 of fixed scroll member 1 is engaged with wall body side step portion 4 of orbiting scroll member 2, and bottom side step portion 3 of orbiting scroll member 2 is engaged with wall body side step portion 4 of fixed scroll member 1. When orbiting scroll member 2 orbitally moves, wall body side step portion 4 provided on each of spiral wall bodies 1*b* and 2*b* slides along a circular arc of bottom side step portion 3 formed on each of end plates 1*a* and 2*a*.

In scroll members 1 and 2 formed as described above, since the height of the compression chamber of the outer peripheral side is large, the outside diameter of the scroll compressor is not increased and, at the same time, the amount of the fluid to be incorporated can be increased. Furthermore, since the height of the compression chamber of the center side is small, the volume of the compression chamber is decreased and, at the same time, the rigidity of the wall bodies is improved.

In the scroll compressor having a structure such as described above, orbiting scroll member 2 undergoes various operations when compression is performed. These operations are explained with reference to FIG. 8. In FIG. 8, shaft 7 (shown in FIG. 6) and crank pin 7*a* (shown in FIG. 6) are not shown.

As shown in FIG. 8, thrust direction gas force Fth and transverse gas force Fg due to the pressure of compression gas which is a fluid, and scroll driving force Fd due to crank pin 7*a* of shaft 7 acts on orbiting scroll member 2.

In other words, thrust direction gas force Fth is a force drawing orbiting scroll member 2 from fixed scroll member 1 along the direction of axis X1 (shown in FIG. 6) by gas pressure in the compression chamber. Additionally, transverse gas force Fg is a force drawing each of spiral wall bodies 1*b* and 2*b* along a transverse direction perpendicular to axis X1 by has pressure in the compression chamber. Furthermore, scroll driving force Fd is a rotational driving force added to boss 2*c* by crank pin 7*a* which rotates around axis X1 when shaft 7 rotates. Moreover, thrust force Fth is borne by an inside end surface of front case 5 on which orbiting scroll member 2 slides.

In the scroll compressor shown in FIG. 8, in order to obtain smooth orbital movement of orbiting scroll member 2, a predetermined clearance 6 (hereinafter, called "tip clearance") is provided between the end of spiral wall body 2*b* of orbiting scroll member 2 and fixed end plate 1*a* of fixed scroll member 1.

By providing tip clearance δ, smooth orbital movement of orbiting scroll member 2 is ensured and resistance to thermal expansion by heat during the process of producing high pressure fluid in scroll members 1 and 2 is also ensured. However, there are problems related to this which are explained below.

As described above, among the forces acting on orbiting scroll member 2, as shown in FIG. 8, scroll driving force Fd and transverse gas force Fg act in opposite directions with respect to each other. As a result, moment M is produced which tends to overturn orbiting scroll member 2 or acts so that orbiting scroll member 2 becomes inclined. Furthermore, orbiting scroll member 2 tends to incline or overturn just by the present of tip clearance δ. In this case, the upper edge of orbiting scroll member 2 exerts pressure force F against fixed end plate 1*a* of fixed scroll member 1.

FIG. 9 is an enlarged side cross-sectional view of this state as seen from the side surface of wall body side step portion 4 of spiral wall body 2*b*. Orbiting scroll member 2 overturned during orbital movement makes point contact or line contact with deep bottom portion 1*e* which is a surface of fixed end plate 1*a* of fixed scroll member 1 at angle A of the convex side end of wall body side step portion 4 formed on spiral wall body 2*b*. This causes a power loss in the rotational drive force and abrasion of deep bottom portion 1*e* and spiral wall body 2*b* of orbiting scroll member 2.

BRIEF SUMMARY OF THE INVENTION

In view of the above problems, it is an object of the present invention to provide a highly reliable scroll compressor which can reduce power loss due to the overturning of an orbiting scroll member and reduce the abrasion of parts.

In order to achieve the above object, the scroll compressor of the present invention has the following constitution.

The present invention is a scroll compressor comprising: a fixed scroll member which has a spiral wall body erected on a side surface of an end plate and which is fixed at a predetermined position; an orbiting scroll member which has a spiral wall body erected on a side surface of an end plate and which is supported so as to be orbitally movable while being prevented from rotating on its own axis, with the pair of spiral wall bodies engaged with each other; and a step portion provided on an upper edge of each spiral wall body in which a height between an upper surface of a bottom portion and the upper edge is low at a center side in a spiral direction and high at an outer peripheral end side, wherein a convex side end of at least one step portion is formed lower than an extrapolated line of the upper edge.

According to the above construction, even if the orbiting scroll member during orbital movement is overturned due to the presence of a tip clearance, the convex side end of the step portion of the spiral wall body does not strongly press against a surface of the end plate of the fixed scroll member, which is opposite the convex side end.

Furthermore, in the similarly formed step portion of the fixed scroll member, the convex side end of the step portion of the spiral wall body of the fixed scroll member does not strongly press against the surface of the end plate of the orbiting scroll member, which is opposite the convex side end.

According to the above construction, since at least one step portion of each scroll member is formed lower than an extrapolated line of the upper edge of the spiral wall body, the scroll members do not make contact with or press against each other when the scroll compressor is operated, therefore abrasion is prevented. Accordingly, a reliable scroll compressor which reduces power loss due to the overturning of an orbiting scroll member and which has a high efficiency is possible.

Furthermore, in the above scroll compressor, the convex side end of at least one of the step portions may have a chamfered shape or a rounded shape.

According to the above construction, even if the orbiting scroll member is overturned due to the presence of a tip clearance during orbital movement, the convex side end of the step portion is not scratched by sliding or does not press against the surface of the end plate, which is opposite to the convex side end. This convex side end is simply formed by removing a 45° angle from the end of the convex side end or rounding the end of the convex side end. Furthermore, if this convex side end is formed on the step portion of the fixed scroll member, the same shape and the same effects are obtained.

Furthermore, since this convex side end is simply formed, the manufacturing cost is decreased. Moreover, the scroll members do not make contact with or press against each other when the scroll compressor is operated, therefore, a reliable scroll compressor having a high efficiency can be provided.

DETAILED DESCRIPTION OF THE INVENTION

The embodiments of the present invention are explained with reference to FIGS. 1A to 5 as follows.

[First Embodiment]

The scroll compressor of the first embodiment is formed by modifying a part of the conventional fixed scroll member 1 and orbiting scroll member 2, and other than these, the overall construction is the same as that of the conventional scroll compressor. When the same components are the same as those of the conventional scroll compressor, the same reference symbols are used and their explanations are omitted.

Figure 1A:
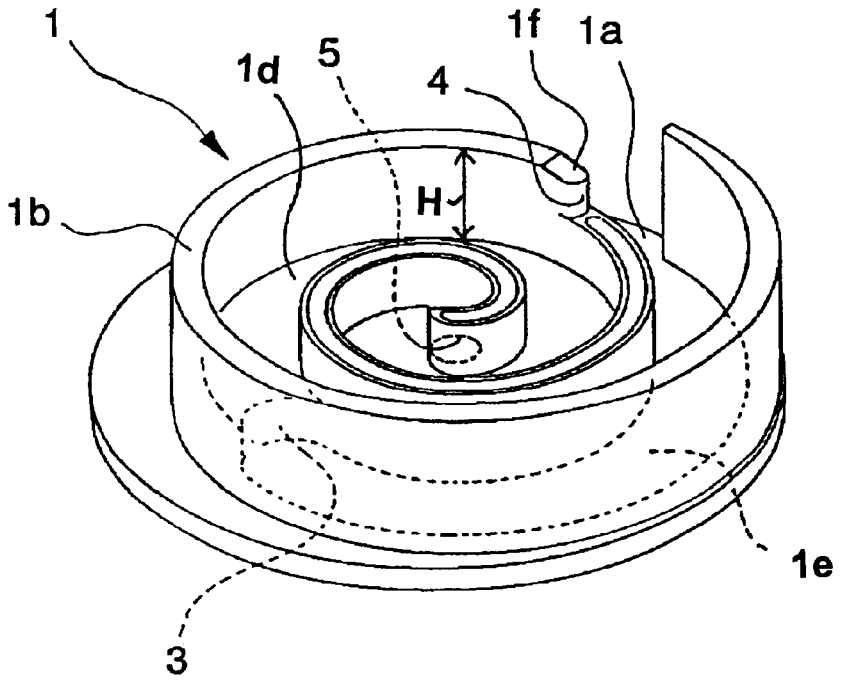
FIG. 1A is a perspective view showing an embodiment of a fixed scroll member which is a component of a scroll compressor according to the present invention.

Referring to FIG. 1A, the step portion 4 is provided on an upper edge of each spiral wall body l*b*in which a height (H) between an upper surface of the bottom portion 1*d,* 1*e* and the upper edge of the spiral wall body 1*b* is low at a center side from the step portion 3 in a spiral direction and high at an outer peripheral end side from the step portion 3.

Figure 1B:
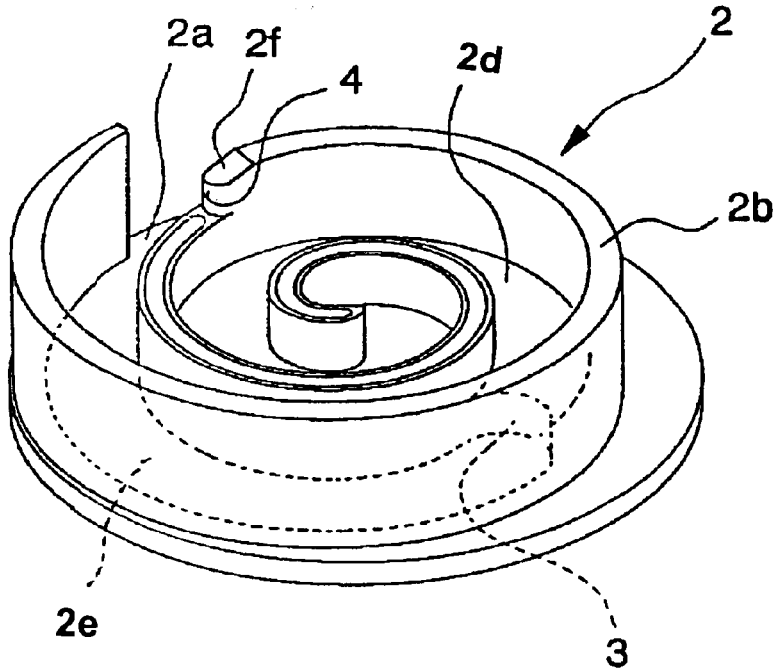
FIG. 1B is a perspective view showing an embodiment of an orbiting scroll member which is a component of a scroll compressor according to the present invention.

FIGS. 1A and 1B are perspective views illustrating scroll members 1 and 2 of the first embodiment according to the present invention. FIG. 1A shows fixed scroll member 1, and FIG. 1B shows orbiting scroll member 2. Each of the first embodiment and the following second to fourth embodiments explains a chamfered portion (chamfer or rounded shape) which is formed at a convex side end of a wall body side step portion 4 (step portion) so as to be lower than an extrapolated line of an upper edge. Wall body side step portion 4 is provided on spiral wall body 2*b* which is erected on one side surface of orbiting end plate 2*a* of orbiting scroll member 2. The chamfered portion, which is explained below, is formed so that the convex side end is lower than the extrapolated line of each upper edge.

Fixed scroll member 1 shown in FIG. 1 comprises a bottom portion formed by spiral wall body 1*b* and is composed of shallow bottom portion 1*d* (high site) which is high at the center side and deep bottom portion 1*e* (low site) which is low at the outer peripheral end side. Bottom portion side step portion 3 (step portion), which is an interface of both bottom portions 1*d* and 1*e,* is formed into a circular arc. Wall body side step portion 4 (step portion) formed on spiral wall body 2*b* of orbiting scroll member 2 is slidably engaged with these bottom portions 1*d* and 1*e*.

Furthermore, orbiting scroll member 2 similarly comprises a bottom portion formed by spiral wall body 2*b* and is composed of shallow bottom portion 2*d* (high site) which is high at the center side and deep bottom portion 2*e* (low site) which is low at the outer peripheral end side. Bottom portion side step portion 3 (step portion), which is an interface of both bottom portions 2*d* and 2*e,* is formed into a circular arc. Wall body side step portion 4 (step portion) formed on spiral wall body 1*b* of fixed scroll member 1 is slidably engaged with these bottom portions 2*d* and 2*e*.

Orbiting scroll member 2 is assembled to fixed scroll member 1, offset thereto by an orbital radius and out of phase by 180 degrees, with spiral wall bodies 1*b* and 2*b* engaging with each other. Fluid is compressed by the orbital movement of orbiting scroll member 2, and compressed fluid is discharged from discharge port 1*c* provided around the center portion of fixed scroll member 1.

Furthermore, on step portions 4 of scroll members 1 and 2 shown in FIG. 1, chamfered portions 1*f* and 2*f* (chamfered shape) are obtained by forming the convex side end so as to be lower than the extrapolated line of the upper edge.

Chamfered portion 2*f* (chamfered shape) is explained with reference to FIG. 2.

Figure 2:
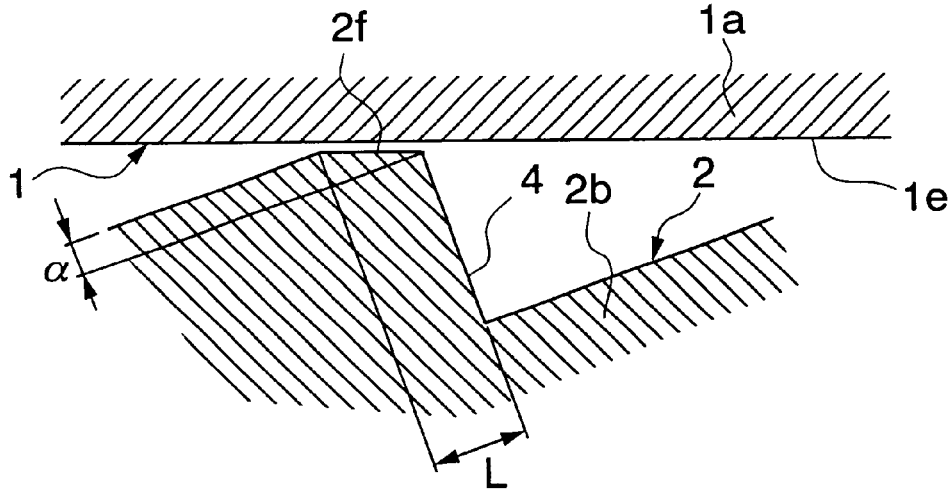
FIG. 2 is a view explaining a first embodiment of the present invention and is a side cross-sectional view illustrating a step portion of the orbiting scroll member of the scroll compressor according to the present invention.

FIG. 2 is a side cross-sectional view explaining the first embodiment of the present invention.

Chamfered portion 2*f* is formed on the convex side end of wall body side step portion 4 of orbiting scroll member 2, as shown in FIG. 1B. Chamfered portion 2*f* is formed by removing a convex side angle portion with chamfer height a and chamfer length L from the extrapolated line of the upper edge of spiral wall body 2*b*. This chamfered portion 2*f* is cut during the molding process of orbiting scroll member 2.

Chamfer height $\alpha$ and chamfer length L, which are the dimensions of chamfered portion 2*f,* are not particularly limited but they are determined corresponding to the shapes or specifications of scroll members 1 and 2. When an overturn angle of orbiting scroll member 2 is calculated, the dimensions of chamfer height $\alpha$ and chamfer length L are preferably determined to make the angle with the extrapolated line of the upper edge of chamfered portion 2*f* correspond to the overturn angle.

Accordingly, when orbiting scroll member 2 overturns during orbital movement, chamfered portion 2*f* of the convex side end of wall body side step portion 4 makes contact with and slides along deep bottom portion 1*e* of fixed end plate 1*a* of fixed scroll member 1. As a result, wall body side step portion 4 does not (strongly) press against and does not cause scratches by sliding along deep bottom portion 1*e* of fixed scroll member 1, and reliability in operation of the scroll compressor can be improved. Particularly, when chamfered portion 2*f* is formed corresponding to the overturn angle of orbiting scroll member 2, chamfered portion 2*f* slides with making surface contact. Therefore, scratches due to sliding are certainly decreased and abrasion is remarkably reduced.

[Second Embodiment]

Figure 3:
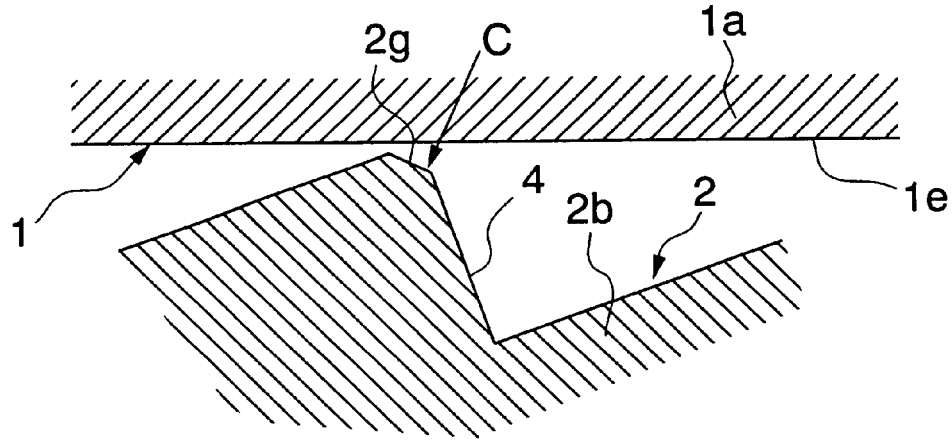
FIG. 3 is a view explaining a second embodiment of the present invention and is a side cross-sectional view illustrating a step portion of the orbiting scroll member of the scroll compressor according to the present invention.

The second embodiment of the scroll compressor according to the present invention is explained with reference to FIG. 3. When the components are the same as those of the first embodiment, the same reference symbols are used and their explanations are omitted.

In the second embodiment, chamfered portion 2*f* is modified in its shape. In the convex side end of wall body side step portion 4 of orbiting scroll member 2, the end of the convex side end is chamfered by removing portion C so as to be chamfered portion 2*g* (chamfered shape). This chamfered portion 2*g* is cut during the molding process of orbiting scroll member 2. Portion C has the same dimensions as the chamfer height and the chamfer width of the portion to be removed. Accordingly, the angle made by a tangent of chamfered portion 2*g* and the extrapolated line of the upper edge is 45 degrees. Furthermore, the dimensions of portion C are determined according to the shapes or the specifications of scroll members 1 and 2.

Therefore, when orbiting scroll member 2 overturns during orbital movement, chamfered portion 2*g* of the convex side end of wall body side step portion 4 makes contact with and slides along deep bottom portion 1*e* of fixed end plate 1*a* of fixed scroll member 1. As a result, wall body side step portion 4 does not (strongly) press against and does not cause scratches by sliding along deep bottom portion 1*e* of fixed scroll member 1, and reliability in operation of the scroll compressor can be improved. Particularly, since the shape of portion C is easily molded, the manufacturing cost can be decreased.

[Third Embodiment]

Figure 4:
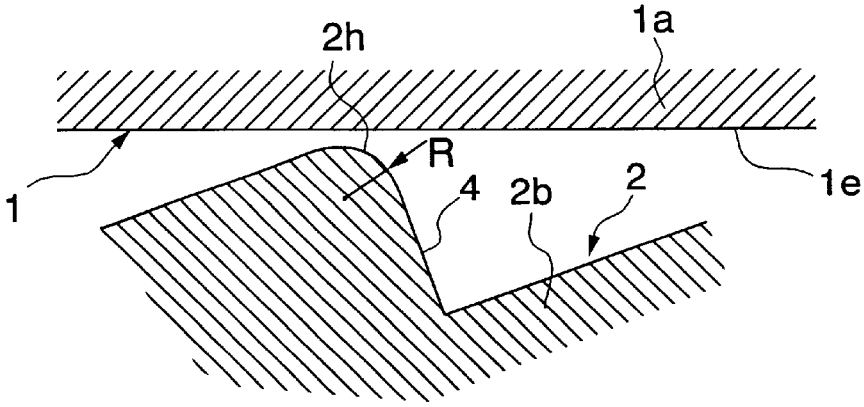
FIG. 4 is a view explaining a third embodiment of the present invention and is a side cross-sectional view illustrating a step portion of the orbiting scroll member of the scroll compressor according to the present invention.

Next, the third embodiment of the scroll compressor according to the present invention is explained with reference to FIG. 4. Components already explained are given the same reference symbols and their explanations are omitted.

In the third embodiment, chamfered portion 2*f* is modified in its shape. In the convex side end of wall body side step portion 4 of orbiting scroll member 2, the end of the convex side end is chamfered by removing round R so as to be chamfered portion 2*h* (round shape). This chamfered portion 2*h* is cut during the molding process of orbiting scroll member 2. The dimensions of round R of the chamfered portion 2*h* are determined according to the shapes or the specifications of scroll members 1 and 2.

Therefore, when orbiting scroll member 2 overturns during orbital movement, chamfered portion 2*h* of the convex side end of wall body side step portion 4 makes contact with and slides along deep bottom portion 1*e* of fixed end plate 1*a* of fixed scroll member 1. As a result, wall body side step portion 4 does not (strongly) press against and does not cause scratches by sliding along deep bottom portion 1*e* of fixed scroll member 1, and reliability in the operation of the scroll compressor can be improved. Particularly, when it starts to make contact by overturning, chamfered portion 2*h* having a round shape smoothly guides orbiting scroll member 2 along the contact surface. As a result, scratches due to sliding are remarkably decreased. Furthermore, since the shape of chamfered portion 2*h* is easily molded, the manufacturing cost can be decreased.

[Fourth Embodiment]

Figure 5:
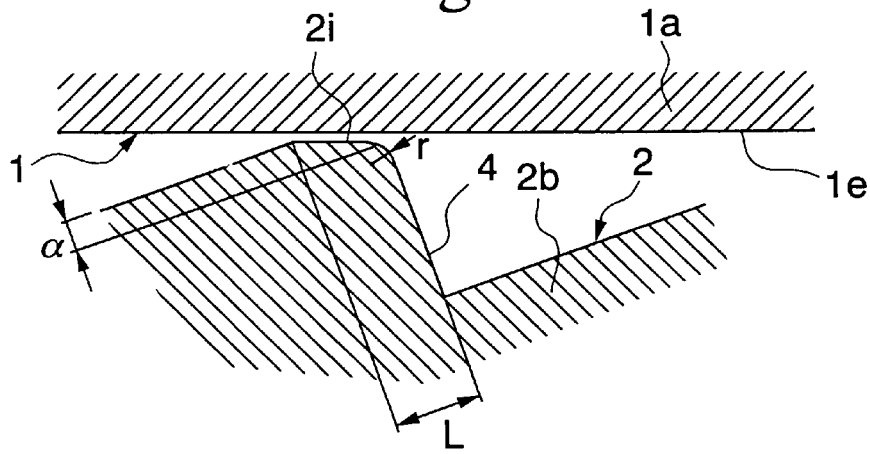
FIG. 5 is a view explaining a fourth embodiment of the present invention and is a side cross-sectional view illustrating a step portion of the orbiting scroll member of the scroll compressor according to the present invention.
Figure 6:
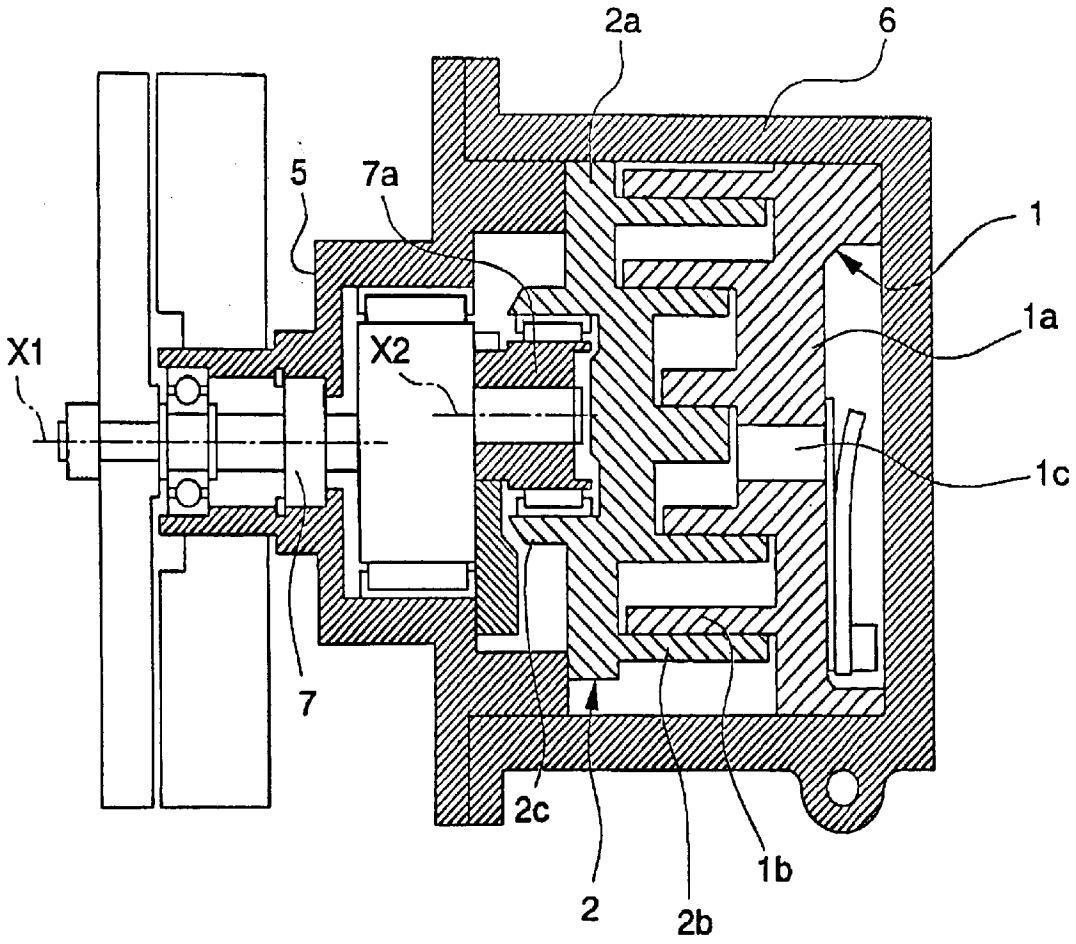
PRIOR ART Fig. 6
FIG. 6 is a cross-sectional view illustrating the overall construction of a conventional scroll compressor.
Figure 7A:
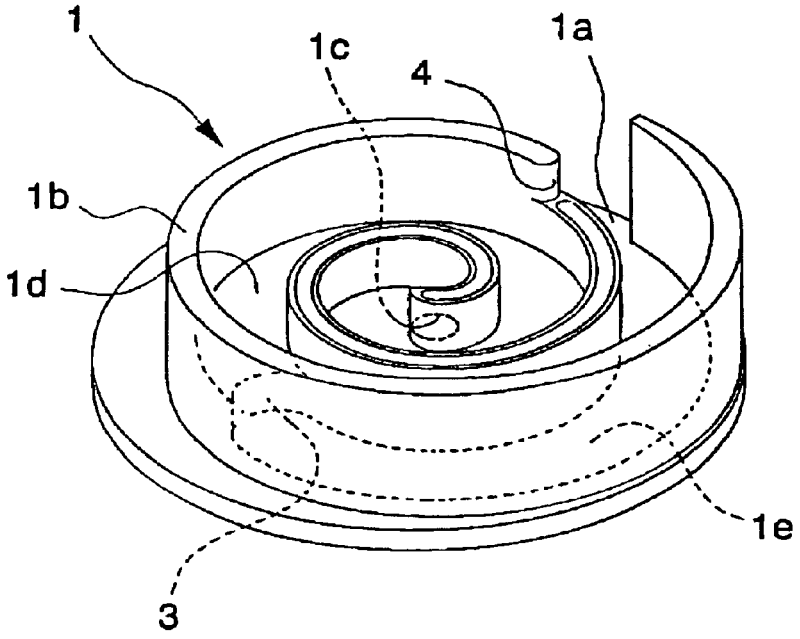
Fig. 7A PRIOR ART
FIG. 7A is a perspective view illustrating a fixed scroll member which is a component of the conventional scroll compressor.
Figure 7B:
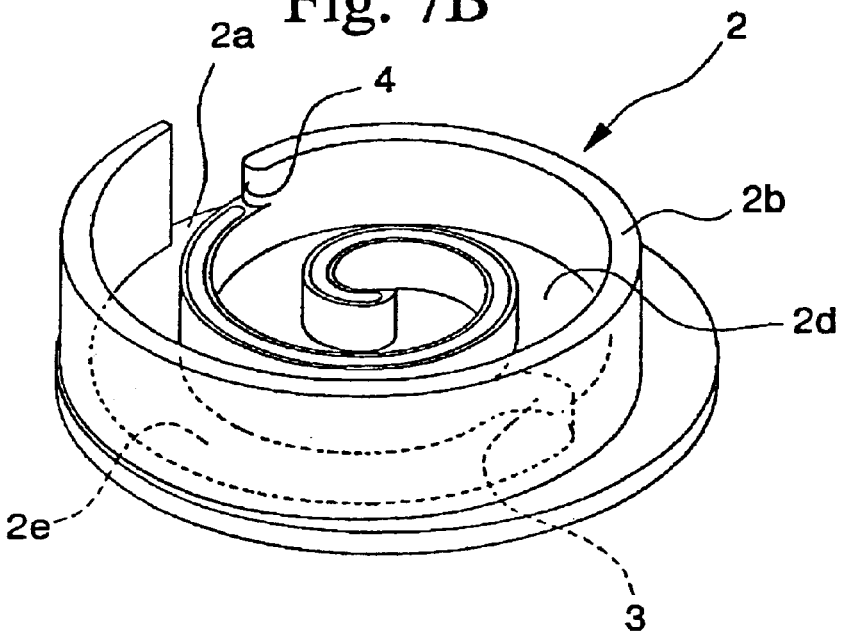
Fig. 7B PRIOR ART
FIG. 7B is a perspective view illustrating an orbiting scroll member which is a component of the conventional scroll compressor.
Figure 8:
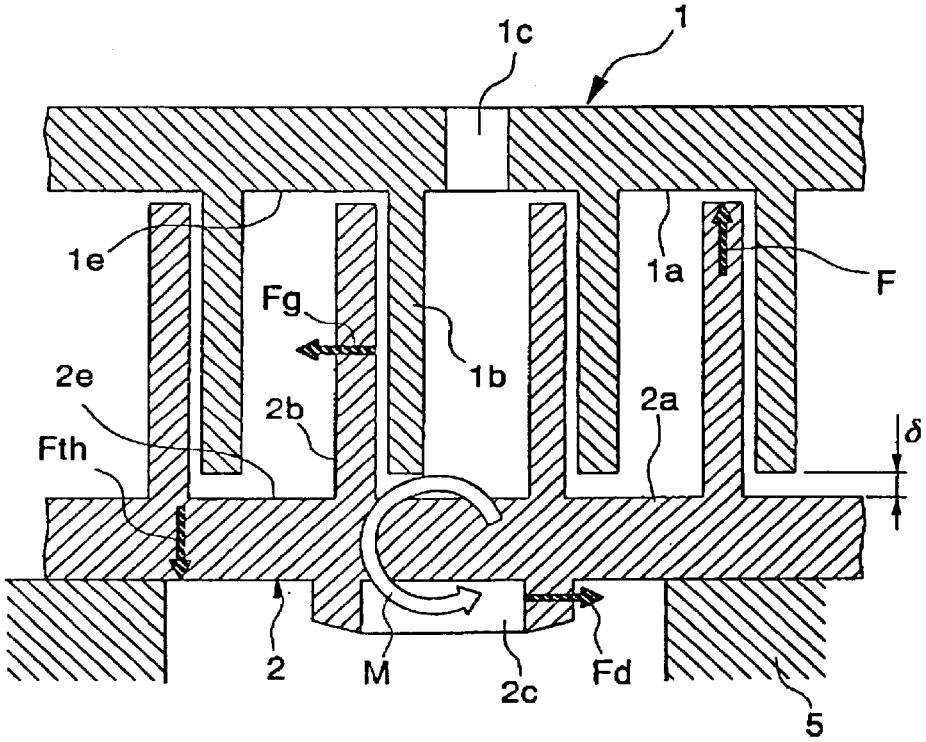
Fig. 8 PRIOR ART
FIG. 8 is a cross-sectional view illustrating the conventional scroll compressor comprising an axis of a shaft and showing a state in which the fixed scroll member and the orbiting scroll member are engaged.
Figure 9:
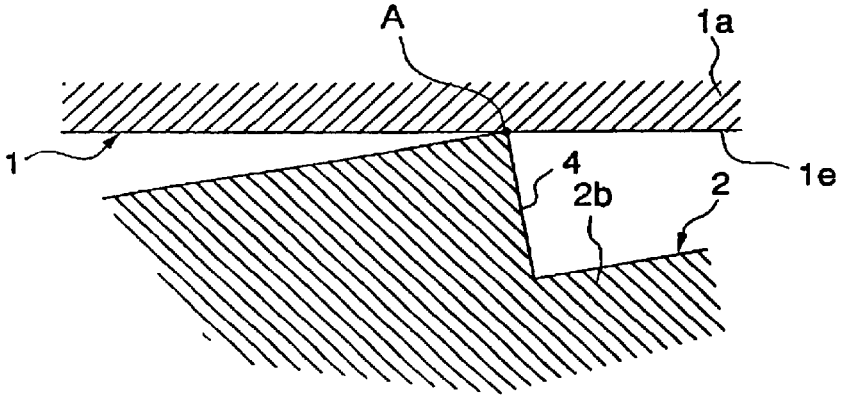
Fig. 9 PRIOR ART
FIG. 9 is a side cross-sectional view illustrating a step portion of the orbiting scroll member according to the conventional scroll compressor and showing a state in which the step portion is engaged with the fixed scroll member.

Next, the fourth embodiment of the scroll compressor according to the present invention is explained with reference to FIG. 5. Components already explained are given the same reference symbols and their explanations are omitted.

In the fourth embodiment, chamfered portion 2*f* is modified in its shape. In the convex side end of wall body side step portion 4 of orbiting scroll member 2, the extrapolated line of the upper edge of spiral wall body 2*b* is chamfered by removing the convex side end with chamfer height $\alpha$ and chamfer length L, and further, chamfered portion 2*i* (chamfered shape) which is provided with round r, is formed. This chamfered portion 2*i* is cut during the molding process of orbiting scroll member 2. Furthermore, the dimensions of chamfer height $\alpha$, chamfer length L, and round diameter r are determined according to the shapes or the specifications of scroll members 1 and 2. When an overturn angle of orbiting scroll member 2 is calculated, chamfer height $\alpha$ and chamfer length L are preferably determined according to the overturn angle.

Therefore, when orbiting scroll member 2 overturns during orbital movement, chamfered portion 2*i* of the convex side end of wall body side step portion 4 makes contact with and slides along deep bottom portion 1*e* of fixed end plate 1*a* of fixed scroll member 1. As a result, wall body side step portion 4 does not (strongly) press against and does not cause scratches by sliding along deep bottom portion 1*e* of fixed scroll member 1, and reliability in the operation of the scroll compressor can be improved. Particularly, due to this shape, chamfered portion 2*i* guides orbiting scroll member 2 toward the sliding surface when it starts to make contact, and power loss of the scroll compressor is further decreased.

In the above embodiments, chamfered portions 2*f*, 2*g*, 2*h*, and 2*i* on step portion 4 of spiral wall body 2*b* of orbiting scroll member 2 are used in its explanations. However, in step portion 4 of spiral wall body 1*b* of fixed scroll member 1, chamfered portion 1*f* shown in FIG. 1 or a portion having a similar shape can be formed.

What is claimed is:

1. A scroll compressor comprising:

a fixed scroll member comprising a first end plate having a first spiral wall body erected on a side surface thereof, said fixed scroll member being fixed at a predetermined position; and an orbiting scroll member comprising a second end plate having a second spiral wall body erected on a side surface thereof, said orbiting scroll member engaging with said fixed scroll member and configured to rotate with respect to said fixed scroll member without rotating on an axis of said orbiting scroll member, wherein the first and second spiral wall bodies have step portions provided on upper edges, respectively, thereof, each of the first and second spiral wall bodies has a height between an upper surface of a bottom portion and the upper edge which is low at a center side in a spiral direction and high at an outer peripheral end side, and a convex side end of at least one of the step portions is formed lower than an extrapolated line of the upper edge along the spiral direction towards the center side.

2. A scroll compressor according to claim 1, wherein the convex side end of at least one of the step portions has a chamfered shape or a rounded shape.

* * * * *